United States Patent [19]

Cook

[11] 4,262,591

[45] Apr. 21, 1981

[54] OFFICE LABEL PRINTER AND DISPENSER

[75] Inventor: Robert C. Cook, 3601 Towne Park Cir., Pomona, Calif. 91767

[73] Assignee: Robert C. Cook, Redondo Beach, Calif.

[21] Appl. No.: 970,809

[22] Filed: Dec. 18, 1978

[51] Int. Cl.[3] ..... B41L 47/46

[52] U.S. Cl. ..... 101/92; 101/227; 101/327; 400/124; 235/449

[58] Field of Search ..... 101/227, 92, 333, 228, 101/327, 291, 292, 328; 400/124; 221/73, 50, 309; 235/61.7, 61.11, 61 PK, 432–433, 437, 454, 449; 156/384, 387, 351, DIG. 33, 37, 45–47, 49

[56] References Cited

U.S. PATENT DOCUMENTS

| | | | |
|---|---|---|---|
| 2,941,188 | 6/1960 | Flechtner | 340/174 |
| 3,453,648 | 7/1969 | Stegenga | 346/76 |
| 3,461,984 | 8/1969 | Phillips | 101/228 |
| 3,698,600 | 10/1972 | Foote | 221/73 |
| 3,729,123 | 4/1973 | Lloyd | 101/228 |
| 3,855,457 | 12/1974 | Amundson | 101/227 |
| 3,923,199 | 12/1975 | Real | 221/73 |
| 3,942,620 | 3/1976 | Dillinger | 400/124 |
| 4,027,141 | 5/1977 | Dubbe | 101/92 |
| 4,085,446 | 4/1978 | Nagamura | 235/449 |
| 4,123,310 | 10/1978 | Varon | 156/351 |

*Primary Examiner*—Edgar S. Burr
*Assistant Examiner*—A. Heinz
*Attorney, Agent, or Firm*—Poms, Smith, Lande & Rose

[57] ABSTRACT

An inexpensive apparatus is provided for printing and dispensing a series of special individualized pressure sensitive labels. The dispenser apparatus includes replaceable storage, such as a cassette or a small floppy disc for storing a series of related addresses, for example, and a full keyboard for providing input to the replaceable memory, together with control circuitry. A cassette of blank pressure sensitive labels mounted on a web is provided, and this web is fed past a photocell, under a printhead and then past a peeling blade which, in one mode, dispenses labels through a slot, with the extension of the labels through the slot being detected by a light and photocell pair which in this mode controls label printing and advancing. In accordance with another mode, the peeling blade from which the labels are dispensed may be disabled, and a set of labels prepared and stored on the takeup reel of the apparatus. An additional control photocell between the cassette and printhead is also provided to indicate when the cassette is empty and to control the printhead in the second mode.

1 Claim, 9 Drawing Figures

OFFICE LABEL PRINTER AND DISPENSER

FIELD OF THE INVENTION

This invention relates to inexpensive individualized label dispensing apparatus.

BACKGROUND OF THE INVENTION

Up to the present time, most mailing labels are either typed out individually, are prepared in large batches of identical labels, or are prepared by mailing services using mailing plates or the like involving mechanical apparatus, or very large and expensive electronic printing equipment.

Accordingly, a principal object of the present invention is to provide a relatively economical and compact apparatus for printing a series of individualized labels.

SUMMARY OF THE INVENTION

In accordance with the complete illustrative system of the present invention, a cassette, including a continuous web and a series of successive pressure-sensitive labels mounted on the web, is removably supported in a label-dispensing apparatus. The labels are routed from the cassette past a photocell and a printhead, and eventually to a takeup reel. A slot is provided in the front of the apparatus, and a peeling blade adjacent the slot dispenses individualized printed labels through the slot. A photocell and light source pair sense the presence of a label extending through the slot and stop the web movement and printing operation as long as a label is extending through the slot. As soon as the user detaches the label to apply it to an envelope, or a package, or the like, a new label is printed and is dispensed or made available for removal at the slot.

In accordance with a special feature of operation of the unit, the peeling blade may be disabled so that the printed labels proceed to storage on the takeup reel. Under this mode of operation, control of the printing of successive labels is shifted to the photocell between the cassette and printhead, which senses light variations associated with successive labels and controls the printhead accordingly. By this alternative mode of operation, a series of labels for a special purpose may be prepared in advance at a central office, and sent out to a particular user having need for the set of labels.

The replaceable memory may, for example, be a cassette or a mini-floppy disc; and suitable storage may be provided in the apparatus for a number of cassettes or floppy discs.

A full scale keyboard may be provided to enter information onto the replaceable storage medium, or to make changes or substitutions on the floppy disc or cassette storage medium.

A liquid crystal display (LCD) or a light-emitting diode (LED) display may be provided to verify the label content in the course of printing and/or recording. A suitable microprocessor and associated access and control circuitry may be provided to interface between the tape or floppy disc unit, the keyboard, the printhead, and the various additional inputs (including photocells), and outputs (including signal lamps).

In accordance with one broad aspect of the invention, pressure-sensitive labels on a web are fed past a printhead, and are dispensed from a peeling blade through a dispensing opening, with the advancing of the web and the printing being accomplished under the control of a sensor which detects the presence of a label extending through the opening; with the web being advanced to dispense a new label each time a label is manually removed from the dispensing opening.

Contributing to the economy of the unit is the simplified output control which may take the form of the interruption of the photocell by the dispensing of a label through a slot in the front of the unit, and the resultant energization of the printhead and the advance circuitry to print a new label and dispense it when the photocell is energized.

Other objects, features, and advantages of the invention will become apparent from a consideration of the following detailed description and from the accompanying drawings.

DETAILED DESCRIPTION

Figure 1:
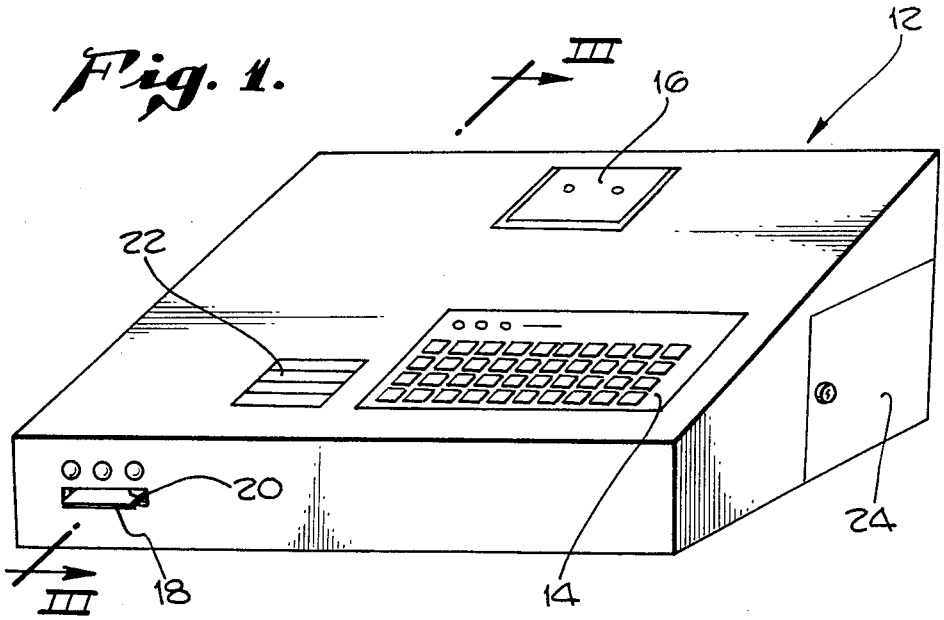
FIG. 1 is an overall view of an individualized label printing and dispensing unit in accordance with the present invention.

Referring more particularly to the drawings, the label printing and dispensing apparatus 12 of the present invention includes a full keyboard 14 for entering information into the replaceable storage medium which is accommodated in the floppy disc or cassette drive unit 16 toward the back of the unit. When the apparatus is employed for preparing sets of address labels, each of the floppy discs or cassettes which are to be used contain a related set of addresses, such as the addresses of a group of customers to whom bills and/or advertising material is to be sent, or salesmen to whom similar instructions or identical letters or other material is to be forwarded. Label information is entered by an operator using the keyboard 14. Subsequently, when the labels are to be printed and dispensed, such as indicated by label 18 extending from slot 20, the machine controls are set to the print mode, and as soon as the operator pulls a label from the slot 18, another label is printed and dispensed through the slot 20.

The display 22, which may for example be a liquid crystal display, or LCD, or a light-emitting diode, or LED, display, shows the blocks of information being printed on the labels when the unit is in the print mode; and shows the blocks of information to be recorded on the large scale replaceable memory when the apparatus is in the write mode.

To the right of the apparatus of FIG. 1 is a storage compartment which may be reached through the door or side panel 24. A series of cassettes or several floppy discs may be stored in this section to the right and to the rear of the unit.

Figure 2:
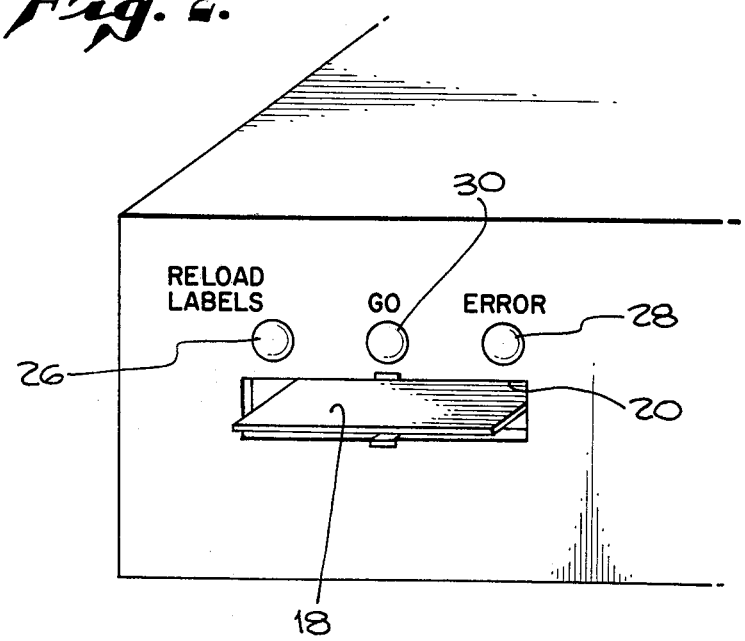
FIG. 2 is an enlarged view of the dispense slot and control signal lamps which are located at the front of the apparatus of FIG. 1.

FIG. 2 shows three signal control lamps, the two red lamps 26 and 28, and the green lamp 30. The red lamp 26 indicates that the label supply in the cassette is exhausted and that a new cassette of labels must be loaded into the unit. The right-hand red light 28 indicates an error, and shows that there has either been a break in the web carrying the labels, that a label has travelled around the peeling blade, or that there is a missing label. The green light 30 flashes on when the label is fully dispensed and ready for removal by the user.

Figure 3:
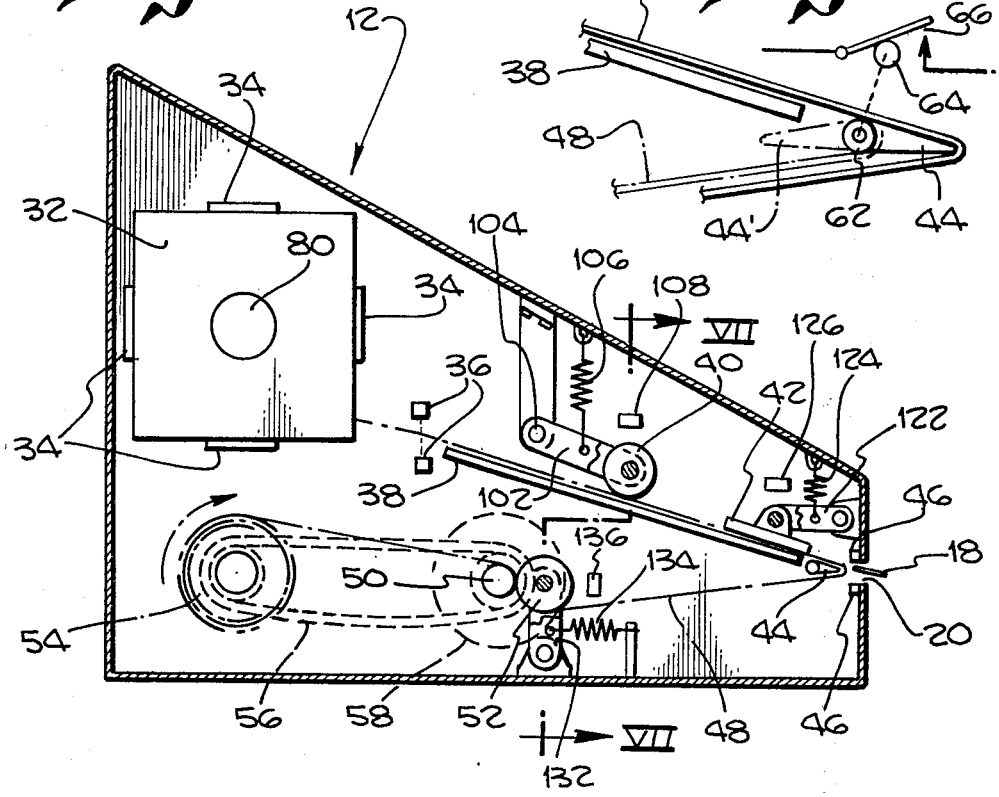
FIG. 3 is a schematic cross-sectional view taken along lines III—III of FIG. 1.

FIG. 3 is a schematic cross-sectional diagram taken along lines III—III of FIG. 1. In FIG. 3 the label cassette 32 is shown mounted between the brackets 34. From the label cassette 32, the web and the labels mounted on it pass between the light and photocell pair 36 along the guide 38 and past the back tension roller 40. The labels then pass under the printhead 42 and around the peeling blade 44 which serves to dispense the label 18 through the slot 20, thereby interrupting the lamp and photocell pair 46. From the peeling blade 44, the web 48 is fed between the drive roll 50 and the pressure roll 52 to the takeup reel 54. Incidentally, the takeup reel 54 may conveniently be driven by a moderately loose belt 56 which engages pulleys mounted on the shaft of the drive motor 58 and the takeup reel 54.

Figure 4:
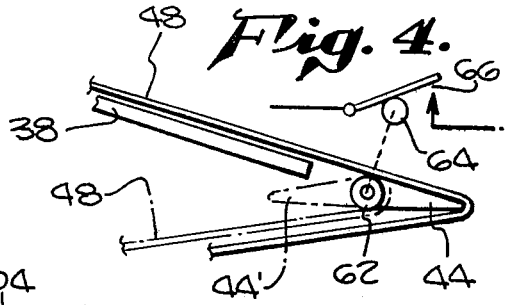
FIG. 4 is a detailed showing of the movable peeling blade which controls the modes of operation of the present unit.

As indicated by the detail of FIG. 4, the peeling blade 44 may be shifted from the operative position designated by the reference numeral 44, to the inactive position indicated by the position designated 44' in FIG. 4 in which the roller 62 is active in facilitating the movement of the web 48 in the new direction toward the drive and pressure rollers 50 and 52. Simultaneously, with the reversal of direction of the peeling blade 44 from its dispense mode to the position shown by the reference numeral 44', the eccentric 64, which is mounted on the pivoting shaft of peeling blade 44, is operated to open the switch contacts 66. This shifts control of the printing and advancing mechanism away from the lamp and photocell pair 46 and over to control by the lamp and photocell pair 36.

Figure 5:
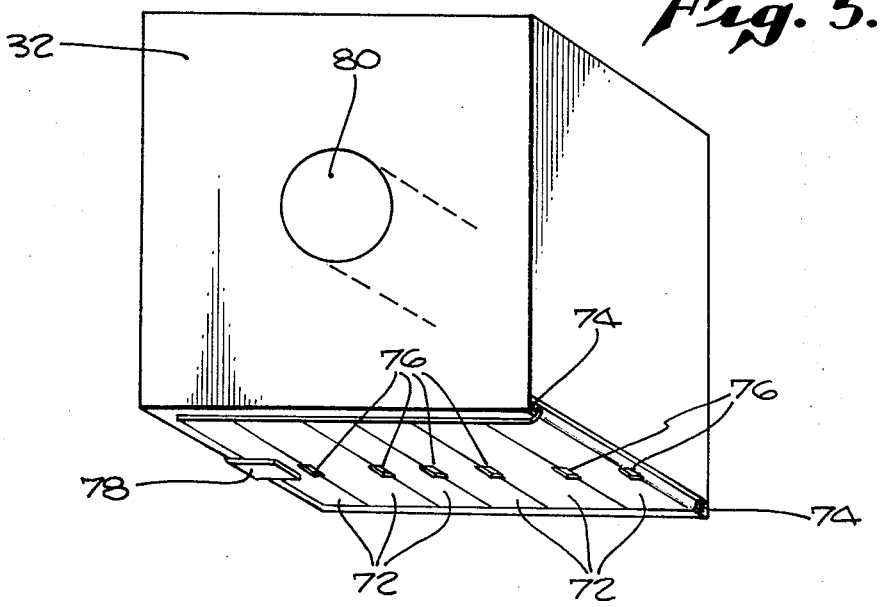
FIG. 5 shows a label cassette.

FIG. 5 is a showing of the cassette 32 with a series of labels 72 extending from the slot 74 near one corner of the cassette 32. The labels 72 are co-extensive with the web on which they are supported, and are butt-cut labels, a term which indicates that the labels are generally rectangular, and that each label immediately abuts the next adjacent labels on either side of it.

Between each pair of labels, however, is a small die-cut opening 76. The lamp and photocell pair 36 are aligned with the centers of the labels 72 and the web on which they are supported so that it senses the transitions from one label to the next and controls the printing of blocks of information by printhead 42 on the individual labels, without any bridging of blocks of information from one label to the next. The strip of pressure-sensitive tape 78 holds the labels in position for easy threading when a new cassette is to be loaded, and would normally be located closer to the slot 74. However, for purposes of illustration of the construction of the butt-cut labels 72 with their die-cut openings 76, the tape has been shown extended across much of the bottom of the cassette 32.

Incidentally, the roll of labels is mounted on a spindle 80 which is indicated schematically in FIG. 3 and in FIG. 5.

Figure 6:
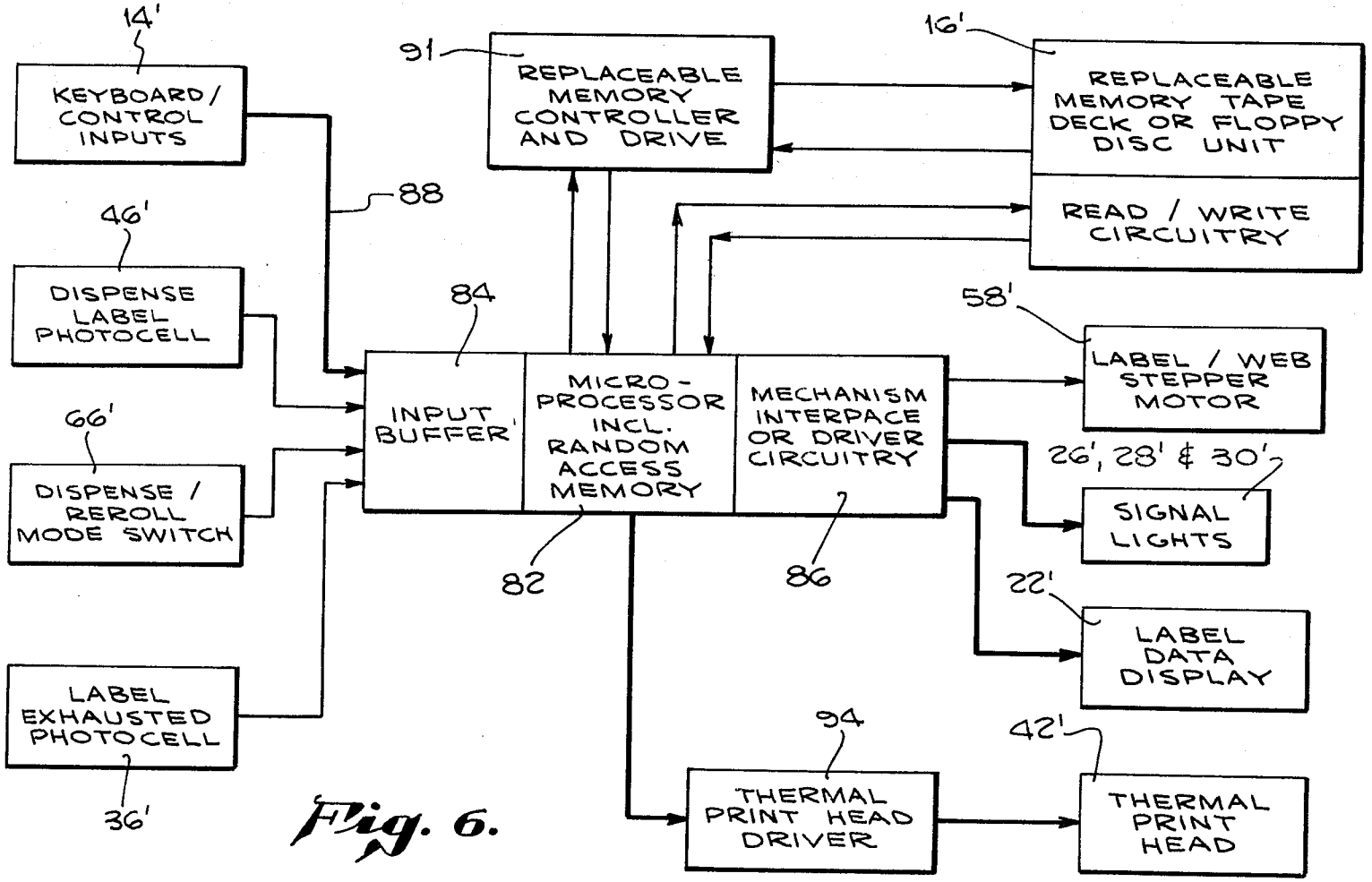
FIG. 6 is a block circuit diagram of the circuitry of the present unit.

Referring now to FIG. 6, this block circuit diagram includes a central microprocessor unit 82, which has associated random access memory (RAM), input buffer circuitry 84 and mechanism interface driver circuitry 86. The input signals to the unit are provided by the blocks shown to the left in FIG. 6, which bear primed reference numerals referring to the corresponding structure shown in previous drawings. These inputs include the keyboard control inputs 14', the dispense label photocell 46', the dispense/re-roll mode switch 66', and the label exhausted photocell 36'. Signals from these inputs are supplied to the input buffer 84. The microprocessor 82 sequentially senses the inputs supplied by the various input blocks mentioned above, normally at a repetition rate so that each input lead is sensed at least once each millisecond, or thousandth of a second. Incidentally, in FIG. 6, leads such as lead 88 between the keyboard/control inputs and the input buffer is shown as a double line to indicate that a number of conductors are employed rather than just a single lead. Such "buses" are required for the transmission of relatively complex information as will emanate from the keyboard, and of the type which must be supplied to the thermal printhead and to the data display unit.

As in the case of the input circuits, the output circuit blocks, shown to the right in FIG. 6, are designated by primed reference numerals which correspond to the unprimed reference numerals employed in the earlier figures of the drawings. These units which are controlled by the microprocessor 82 include the replaceable memory 16', the stepper motor 58', the signal lights 26', 28', and 30', the label data display 22', and the thermal printhead 42'. Of course, each of these units must be supplied with signals at the proper power levels and at the proper timing for appropriate operation. In order to provide such signals, the low level microprocessor output signals must be shifted to appropriate power levels, and this is accomplished as shown in FIG. 6, by the mechanism interface or drive circuitry 86, by the memory controller and drive 91, and by the thermal printhead driver 94. Through the use of these separate or consolidated circuits, suitable power levels are supplied to each of the units controlled by the microprocessor 82.

Incidentally, concerning the matter of disabling the peeling blade 44 as shown in FIG. 4, and the resultant alternative mode of operation of the unit, several points may be noted. First, if the unit is only to be operated using the peeling blade in operation, and dispensing labels through the slot, then the die cut openings 76 between labels are not needed, and the photocell and light pair 36 are only employed to sense the exhaustion of the cassette of labels. If both modes are to be used, however, then the photocell and light pair 36 are employed both to energize signal light 26 (see FIG. 2) when the photocell is on continuously, or is energized more intensely than is possible through the thin die cut slots 76. Also, in the second mode, when the peeling blade 44 is disabled, the photocell 36 provides control signals to insure that a block of information intended for a single label is in fact applied only to one single label by the printhead 42.

For completeness, the following data processing subroutine is included, to indicate more specifically the mode of operation of the green "GO" signal lamp, and red "ERROR" signal lamp.

SIGNAL LAMP ENERGIZATION SUBROUTINE

1. Label in dispense slot with unit and switch 66 in "dispense" mode of operation.

2. Label removed; photocell 46 energized.

3. A. Stepper advance motor 58 energized for limited advance.

B. Printer 42 operates.

C. Error checking circuit timing cycle initiated.

4. A. Photocell 46 interrupted and green light 30 flashes

OR

B. If photocell 46 is not interrupted after predetermined time interval, red error light 28 is turned on.

With the foregoing mode of operation, the user will defer pulling the labels until the green lamp is flashing, and thus will not pull on the labels ahead of time, which could shift the position of the labels and interfere with the label-printhead indexing. Energization of the red "error" lamp would clearly indicate that the web had broken or that the labels are going around the peeling blade.

Figure 7:
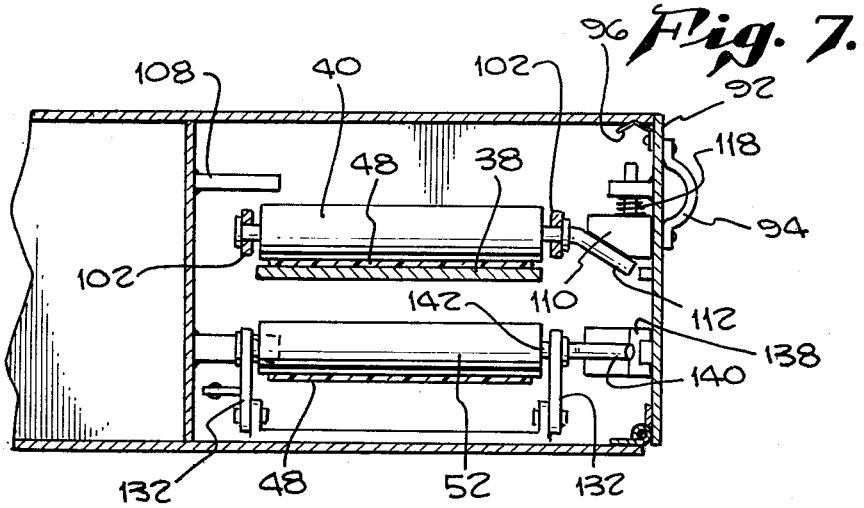
FIGS. 7, 8, and 9 show a set of mechanisms which open the label feed path when an access door is opened to replace the label cassette.
Figure 8:
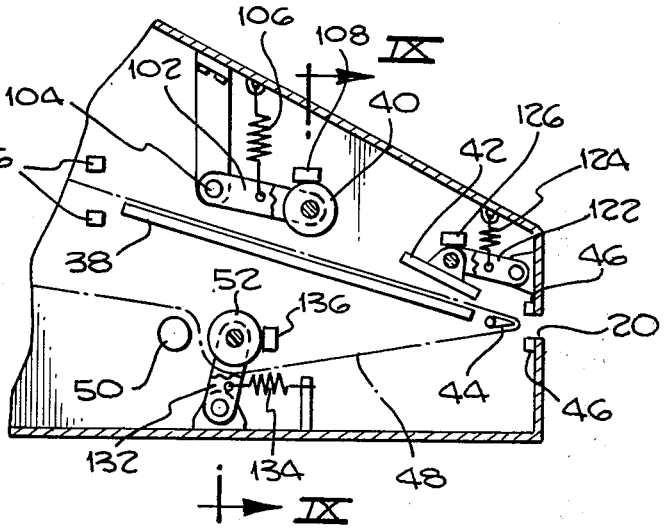
Figure 9:
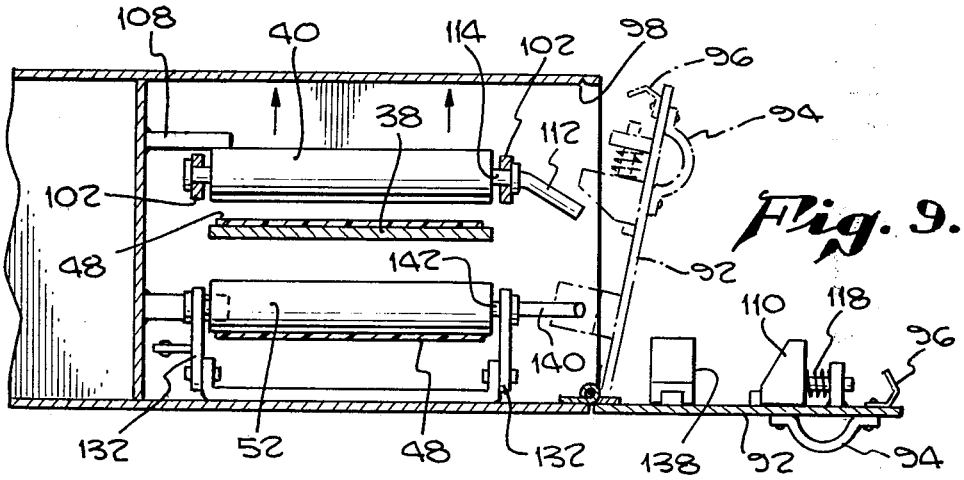

FIGS. 7, 8 and 9 of the drawings are included to provide a schematic showing of one implementation of arrangements to open the feed path for the labels and their associated web when the door 92 is opened to remove the labels and webbing from the takeup reel 54, and to supply a new cassette 32 to the unit. The feed path for the webbing and the associated labels extends from the cassette 32 (see FIG. 3) past the tensioning roller 40, under the printhead 42, past the peeling blade 44 and between the drive roller 50 and the pressure roller 52, with eventual winding up of the material on a rewind roller or reel 54. As shown in FIGS. 7 through 9 of the drawings, when the door 92 is opened by grasping the handle 94 and pulling the latch 96 free of the recess or catch 98 in the housing, the feed path for the labels and web is opened, to facilitate the easy threading of the web 48 from the new cassette to the rewind reel 54.

As shown to advantage in FIG. 8, the back tension roller is mounted on a pair of arms 102, which are pivoted about the axis 104. The back tension roller 40 is biased by a relatively weak spring 106 into engagement with the stop 108 when the door 92 is opened. This of course takes the roller out of engagement with the web 48, thereby permitting easy threading of the web 48. When the door 92 is closed, the spring biased cam 110 engages the downwardly angled end 112 of the fixed shaft 114 on which the roller 40 is mounted. As shown in FIG. 7, this forces the roller 40 down in resilient engagement with the web 48 under the spring force applied by the coil spring 118 which exerts downward force on the cam 110.

In a similar manner to the arrangements set forth above for the roller 40, the printhead 42 and the pressure roller 52 are moved out of firm engagement with the web 48 when the door 92 is closed. More specifically, the printhead 42 is pivotally mounted on the linkages 122 and is biased by the relatively weak spring 124 into engagement with the stop 126. It is moved upwardly by a cam arrangement similar to that shown at 110 for the back tension roller 40. Concerning the pressure roller 52, it is mounted on a pair of linkages 132 and is biased by the relatively weak spring 134 into engagement with the stop 136 when the door 92 is open. When the door 92 is closed, the cam 138 engages the end 140 of the shaft 142 and resiliently biases the pressure roller 52 into firm engagement with the drive roller 50.

Accordingly, the feed path for the labels and the associated backing webbing, is opened when the door 92 is opened, and the back tensioning roller 40, the printhead 42, and the pressure roller 52, are resiliently and firmly pressed into engagement with the web 48 when the door 92 is closed. It is to be understood that other mechanical mechanisms instead of the schematically shown cams of FIGS. 7 through 9 could be employed to perform the functions as described hereinabove.

In conclusion, it is to be understood that the apparatus disclosed in the present detailed description is merely illustrative of the principles of the invention, and that minor changes and modifications may be made. By way of example, and not of limitation, instead of a thermal printer, other forms of printing including electrosensitive and impact printing could be utilized, a microswitch could be employed instead of one or both of the photocells 36 and 46, and other similar minor modifications could be incorporated into the system. Accordingly, the present invention is not to be limited to the precise embodiment shown in the drawings and described hereinabove.

What is claimed is:

1. A simplified individualized label printing and/or dispensing apparatus for butt-cut pressure sensitive labels, said apparatus having both a label-dispensing mode and a rewind mode, comprising:

an outer casing for said apparatus;

a cassette containing a continuous supporting web and a series of successive butt-cut pressure sensitive labels mounted on said web;

means for supporting said cassette within said casing to dispense said web and labels;

replaceable large scale memory means for storing successive different blocks of information to be applied respectively to successive ones of said labels;

means including a printhead for applying said blocks of stored information to successive labels;

means for feeding said web past said printhead to receive one of said blocks of information on each label;

a peeling blade having a peeling edge, mounted adjacent a slot through said outer casing;

means for feeding said web over said peeling blade and for stopping the movement of said web with a label extending through said slot;

first photocell means located beyond the peeling edge of said peeling blade and close thereto for detecting whether a label is extending from said peeling blade through said slot;

means responsive to the energization of said first photocell means for enabling the advancing of said web, and printing an additional label with information contained in the next block of stored information, said web feeding means being responsive solely to said first photocell means to feed said web to extend the label through said slot;

means for rewinding the web after it passes the printhead and peeling blade;

second photocell means including a light and photocell pair for detecting the transmission of illumination along a path through said web and labels between said cassette and said printhead;

means responsive to the output of said second photocell means for controlling the operation of said apparatus during the rewind mode; and means for moving said peeling blade so that it does not engage said web and for concurrently actuating a switch to modify the mode of operation of said apparatus from the dispense mode to the rewind mode, and to print labels and store said printed labels on said rewinding means, and to disable said first photocell means and to shift control of the wet feeding means to said light and photocell pair.

* * * * *